US006880460B2

(12) United States Patent
Sakamoto

(10) Patent No.: US 6,880,460 B2
(45) Date of Patent: Apr. 19, 2005

(54) PRINTING PLATE MOUNTING APPARATUS

(75) Inventor: Tatsuya Sakamoto, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 56 days.

(21) Appl. No.: 10/378,928

(22) Filed: Mar. 5, 2003

(65) Prior Publication Data

US 2003/0172826 A1 Sep. 18, 2003

(30) Foreign Application Priority Data

Mar. 15, 2002 (JP) ..... 2002-071169
Mar. 15, 2002 (JP) ..... 2002-071170

(51) Int. Cl.[7] ..... B41F 1/28
(52) U.S. Cl. ..... 101/415.1; 101/383
(58) Field of Search ..... 101/378, 382.1, 101/383, 415.1, 477, DIG. 36; 33/614, 615, 617–621

(56) References Cited

U.S. PATENT DOCUMENTS 1,373,656 A * 4/1921 Drange ..... 101/415.1
4,157,067 A * 6/1979 Datwyler ..... 101/415.1
5,218,907 A * 6/1993 Komori et al. ..... 101/415.1
5,322,014 A * 6/1994 Keller ..... 101/415.1
5,402,727 A * 4/1995 Matsuo et al. ..... 101/486
5,479,859 A * 1/1996 Lindner et al. ..... 101/485
5,485,783 A 1/1996 Rau et al.
5,553,545 A * 9/1996 Turner ..... 101/415.1

FOREIGN PATENT DOCUMENTS

| | | |
|---|---|---|
| JP | 3-36666 | 6/1991 |
| JP | 4-6915 | 2/1992 |
| JP | 2635514 | 4/1997 |
| JP | 11-77966 | 3/1999 |

* cited by examiner

*Primary Examiner*—Ren Yan
(74) *Attorney, Agent, or Firm*—McDermott Will & Emery LLP

(57) ABSTRACT

A printing plate is mounted peripherally of a first plate cylinder or a second plate cylinder by using a forward-end clamping mechanism having a forward-end clamping jaw and an air cylinder for opening and closing the forward-end clamping jaw, and a rear-end clamping mechanism having a rear-end clamping jaw and two air cylinders for opening and closing the rear-end clamping jaw. The forward-end clamping mechanism is used for clamping the forward end of the printing plate. The rear-end clamping mechanism is used for clamping the rear end of the printing plate and straining the printing plate over the periphery of the first or second plate cylinder.

19 Claims, 19 Drawing Sheets

PRINTING PLATE MOUNTING APPARATUS

BACKGROUND OF THE INVENTION

1. Field of the Invention

This invention relates to a printing plate mounting apparatus for mounting printing plates peripherally of a plate cylinder.

2. Description of the Related Art

Such a printing plate mounting apparatus includes a forward-end clamping jaw disposed peripherally of a plate cylinder for pinching the forward end of a printing plate with a clamping base, and a rear-end clamping jaw disposed peripherally of the plate cylinder for pinching the rear end of the printing plate with a clamping base. In the conventional printing plate mounting apparatus, the forward-end clamping jaw and rear-end clamping jaw are opened and closed manually. In order to open and close the clamps automatically, clamp switching devices are arranged outwardly of the plate cylinder.

That is, in the conventional printing plate mounting apparatus, the forward-end clamping jaw and rear-end clamping jaw are biased by springs or the like in directions for contacting the clamping bases, respectively. When opening the forward-end clamping jaw and rear-end clamping jaw, air cylinders or the like arranged peripherally of the plate cylinder are used to move the forward-end clamping jaw and rear-end clamping jaw away from the respective clamping bases. Such a printing plate mounting apparatus is disclosed in Japanese Examinated Utility Model Publication 1992-6915, for example.

With the construction noted above for moving the forward-end clamping jaw and rear-end clamping jaw away from the clamping bases by using air cylinders or the like arranged peripherally of the plate cylinder, the plate cylinder must be set to a predetermined angular position and fixed firmly thereto against rotation by the pressing forces of the air cylinders. Thus, not only are plate feeding and removing operations time-consuming, but the apparatus is complicated in construction.

SUMMARY OF THE INVENTION

The object of this invention, therefore, is to provide a printing plate mounting apparatus simple in construction, and yet capable of quickly opening and closing a forward-end clamping jaw and a rear-end clamping jaw.

The above object is fulfilled, according to this invention, by a printing plate mounting apparatus for mounting a printing plate peripherally of a plate cylinder, comprising a forward-end clamping jaw disposed peripherally of the plate cylinder for pinching a forward end of the printing plate with a clamping base, a forward-end clamping jaw switching device disposed on the plate cylinder for opening and closing the forward-end clamping jaw, a rear-end clamping jaw disposed peripherally of the plate cylinder for pinching a rear end of the printing plate with a clamping base, a rear-end clamping jaw switching device disposed on the plate cylinder for opening and closing the rear-end clamping jaw, and a straining device disposed on the plate cylinder for moving one of the forward-end clamping jaw and the rear-end clamping jaw in a direction for straining the printing plate pinched.

With this printing plate mounting apparatus, the forward-end clamping jaw, forward-end clamping jaw switching device, rear-end clamping jaw, rear-end clamping jaw switching device and straining device are all arranged on the printing cylinder. Thus, the forward-end clamping jaw and rear-end clamping jaw may be opened and closed quickly.

In a preferred embodiment of the invention, the straining device is arranged to strain the printing plate pinched by the forward-end clamping jaw and the rear-end clamping jaw, by rotating one of the forward-end clamping jaw and the rear-end clamping jaw with the clamping base.

Preferably, the plate cylinder is an n-segmented cylinder, where n is an integer 2 or more, for supporting printing plates n in number, the forward-end clamping jaw, the forward-end clamping jaw switching device, the rear-end clamping jaw, the rear-end clamping jaw switching device and the straining device, respectively, are n in number and arranged equidistantly.

The forward-end clamping jaw switching device and the rear-end clamping jaw switching device may include air cylinders, respectively, the air cylinders being connected to an air source disposed outwardly of the plate cylinder, through a rotary joint disposed axially of the plate cylinder.

In another preferred embodiment, the printing plate mounting apparatus comprises a plate pop-up device for projecting one of the forward end and the rear end of the printing plate outwardly of an outer periphery of the plate cylinder when one of the forward-end clamping jaw and the rear-end clamping jaw is opened to remove the printing plate from the plate cylinder.

Preferably, a guide member is disposed adjacent the outer periphery of the plate cylinder for guiding, toward a plate store, the one of the forward end and the rear end of the printing plate projected by the pop-up device outwardly of the outer periphery of the plate cylinder.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of this invention will be described hereinafter with reference to the drawings.

[Overall Construction of Printing Machine]

Figure 1:
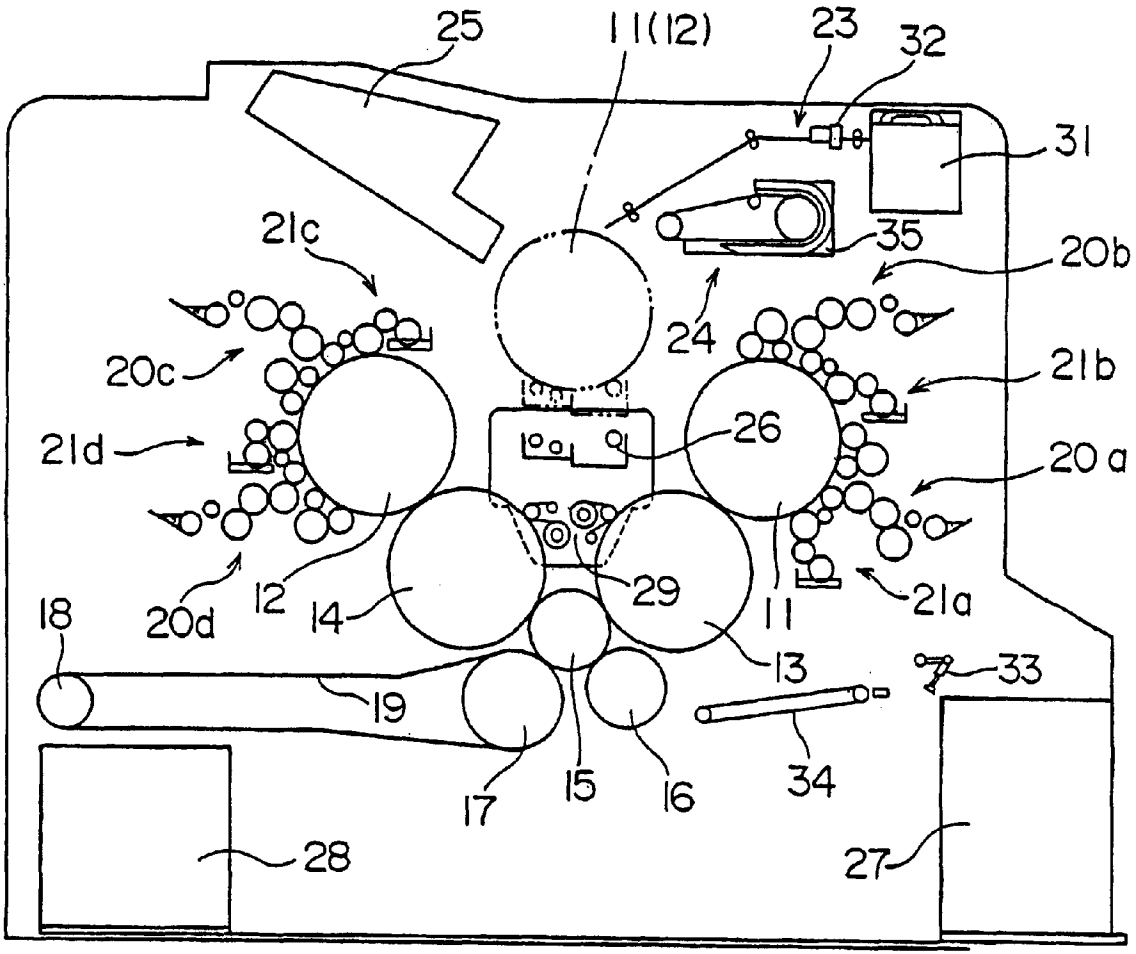
FIG. 1 is a schematic side view of a printing machine according to this invention.

An overall construction of a printing machine according to this invention will be described first. FIG. 1 is a schematic side view of a printing machine according to the invention.

This printing machine records images on two blank plates mounted on a first plate cylinder 11 and two blank plates mounted on a second plate cylinder 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to one of the plates, an ink feeder 20*b* for feeding an ink of magenta (M), for example, to the other plate, and dampening water feeders 21*a* and 21*b* for feeding dampening water to the plates. Around the second plate cylinder 12 in the second printing position are an ink feeder 20*c* for feeding an ink of cyan (C), for example, to one of the plates, an ink feeder 20*d* for feeding an ink of yellow (Y), for example, to the other plate, and dampening water feeders 21*c* and 21*d* for feeding dampening water to the plates. Further, an image recorder 25 and a developing device 26 are arranged around the first or second plate cylinder 11 or 12 in the image recording position.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The machine further includes a paper feed cylinder 16 for transferring printing paper supplied from a paper store 27 to the impression cylinder 15, a paper discharge cylinder 17 with chains 19 wound thereon for discharging printed paper from the impression cylinder 15 to a paper discharge station 28, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

A plate feeder 23 and a plate remover 24 are arranged around the first or second plate cylinder 11 or 12 in the image recording position.

The plate feeder 23 includes a supply cassette 31 storing a roll of elongate blank plate in light-shielded state, a guide mechanism having guide plates and transport rollers for guiding a forward end of the plate drawn from the cassette 31 to the surface of the first or second plate cylinder 11 or 12, and a cutter 32 for cutting the elongate plate into sheet plates. Each of the first and second plate cylinders 11 and 12 has clamping jaws, not shown, for clamping the forward and rear ends of each printing plate fed from the plate feeder 23.

The plate remover 24 has a discharge cassette 35 for receiving and storing, in an approximately U-shaped state, the plates from the first or second plate cylinder 11 or 12 after a printing operation.

The forward end of the plate drawn from the supply cassette 31 in the plate feeder 23 is guided by the guide mechanism, and clamped by one of the clamping jaws on the first or second plate cylinder 11 or 12. Then, the first or second plate cylinder 11 or 12 is rotated by the plate cylinder rotating mechanism, whereby the plate is wrapped around the first or second plate cylinder 11 or 12. The rear end of the plate cut by the cutter 32 is clamped by the other clamping jaw. After the above operation is carried out for two plates, the first or second plate cylinder 11 or 12 is rotated at low speed, the image recorder 25 irradiates the surfaces of the plates mounted peripherally of the first or second plate cylinder 11 or 12 with a modulated laser beam for recording images thereon.

On one of the plates mounted peripherally of the first plate cylinder 11, the image recorder 25 records an image area to be printed with black ink. On the other plate mounted peripherally of the first plate cylinder 11, the image recorder 25 records an image area to be printed with magenta ink. On one of the plates mounted peripherally of the second plate cylinder 12, the image recorder 25 records an image area to be printed with cyan ink. On the other plate mounted peripherally of the second plate cylinder 12, the image recorder 25 records an image area to be printed with yellow ink.

As noted hereinbefore, the ink feeders 20*a* and 20*b* are arranged around the first plate cylinder 11 in the first printing position, while the ink feeders 20*c* and 20*d* are arranged around the second plate cylinder 12 in the second printing position. Each of these ink feeders 20*a*, 20*b*, 20*c* and 20*d* (which may be referred to collectively as "ink feeders 20") includes a plurality of ink rollers and an ink source.

The ink rollers of the ink feeders 20*a* and 20*b* are swingable by action of cams or the like not shown. With the swinging movement, the ink rollers of the ink feeder 20*a* or

20*b* come into contact with one of the two image areas formed on the two plates mounted peripherally of the first plate cylinder 11. Thus, the ink is fed only to an intended one of the image areas. Similarly, the ink rollers of the ink feeders 20*c* and 20*d* are swingable by action of cams or the like not shown. With the swinging movement, the ink rollers of the ink feeder 20*c* or 20*d* come into contact with one of the two image areas formed on the two plates mounted peripherally of the second plate cylinder 12. Thus, the ink is fed only to an intended one of these image areas.

The dampening water feeders 21*a*, 21*b*, 21*c* and 21*d* (which may be referred to collectively as "dampening water feeders 21") feed dampening water to the plates before the ink feeders 20 feed the inks thereto. Of the dampening water feeders 21, the water feeder 21*a* feeds dampening water to the image area on one of the plates mounted on the first plate cylinder 11, and the water feeder 21*b* feeds dampening water to the image area on the other plate mounted on the first plate cylinder 11. Similarly, the water feeder 21*c* feeds dampening water to the image area on one of the plates mounted on the second plate cylinder 12, and the water feeder 21*d* feeds dampening water to the image area on the other plate mounted on the second plate cylinder 12.

The developing device 26 is disposed under the first plate cylinder 11 or second plate cylinder 12 in the image recording position. This developing device 26 includes a developing unit, a fixing unit and a squeezing unit, which are vertically movable between a standby position shown in solid lines and a developing position shown in two-dot chain lines in FIG. 1.

In developing the images recorded on the plates by the image recorder 25, the developing unit, fixing unit and squeezing unit are successively brought into contact with the plates rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper for holding and transporting the forward end of each sheet of printing paper fed from the paper storage 27 by a reciprocating suction board 33. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has a pair of chains 19 wound around opposite ends thereof. Each of the chains 19 has grippers arranged at intervals thereon, each interval corresponding to the perimeter of the impression cylinder 15. When the impression cylinder 15 transfers the printing paper to the discharge cylinder 17, one of the grippers of the discharge cylinder 17 holds the forward end of the printing paper having been held by the gripper of the impression cylinder 15. With movement of the chains 19, the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 2:
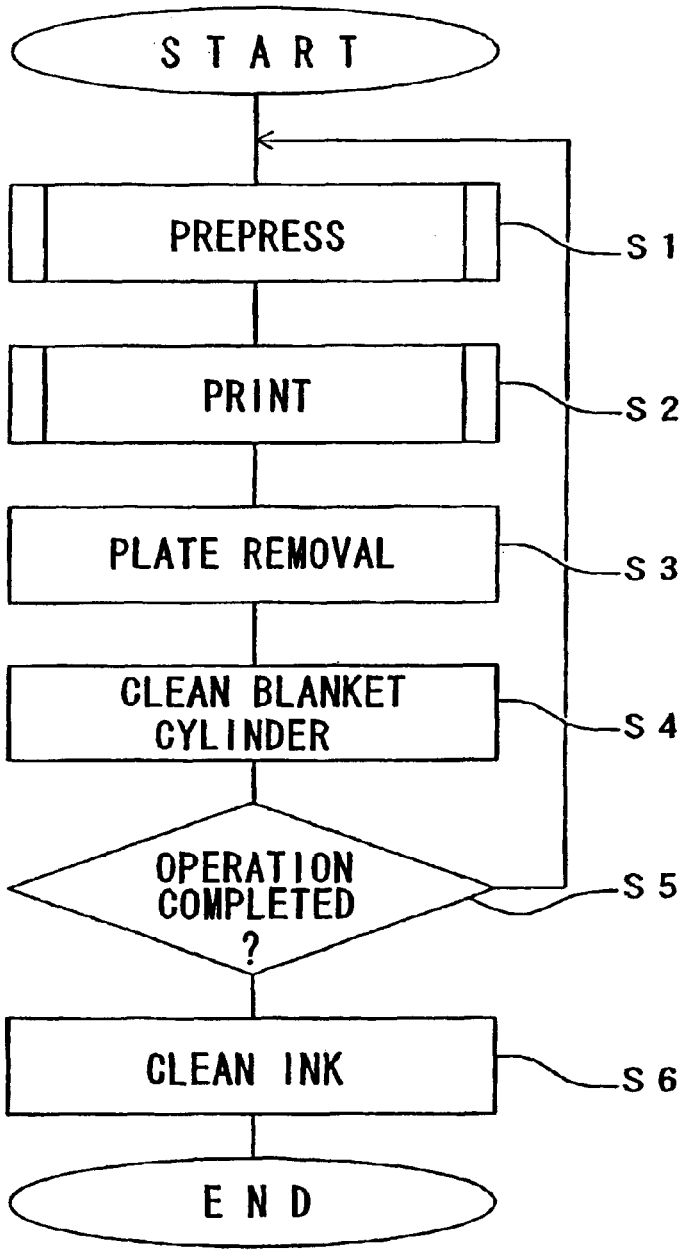
FIG. 2 is a flow chart of prepress and printing operations of the printing machine.

Prepress and printing operations of this printing machine will be described next. FIG. 2 is a flow chart showing an outline of the prepress and printing operations of the printing machine. These prepress and printing operations are directed to multicolor printing of printing paper with the four color inks of yellow, magenta, cyan and black.

Figure 3:
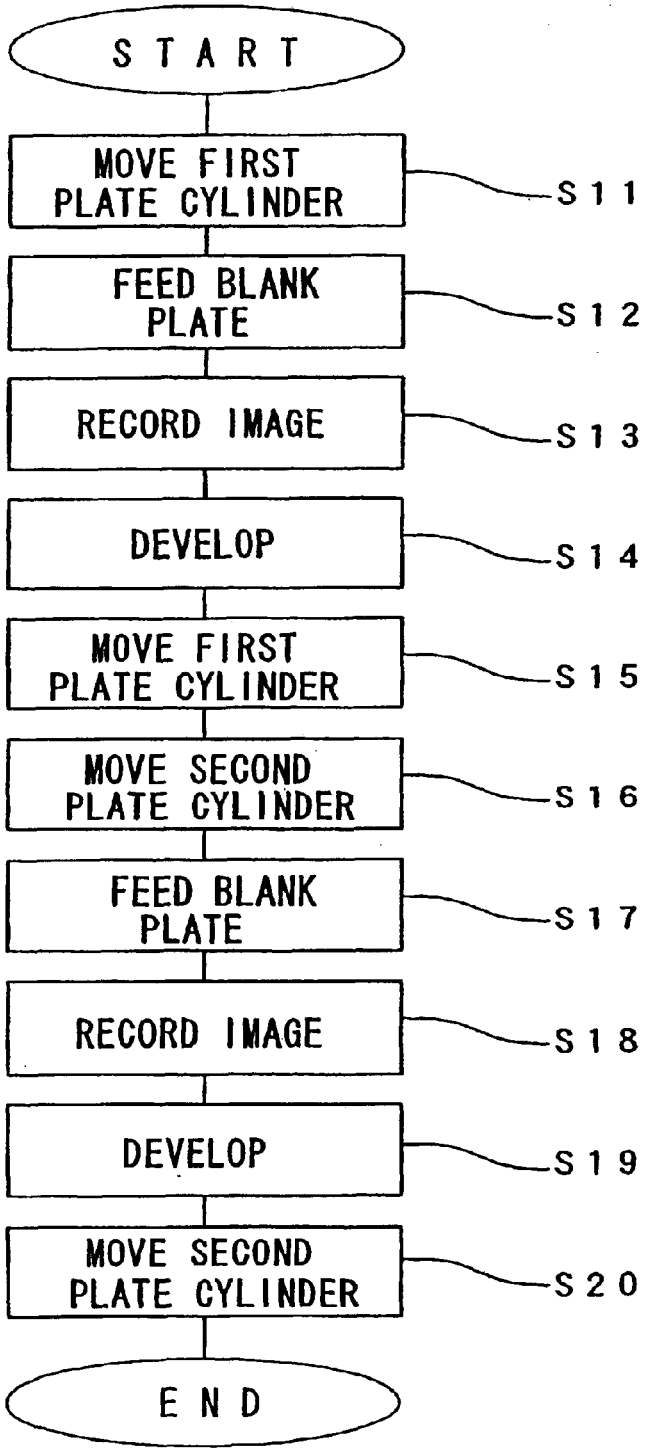
FIG. 3 is a flow chart of a prepress process.

First, the printing machine executes a prepress process for recording and developing images on the plates mounted on the first and second plate cylinders 11 and 12 (step S1). This prepress process follows the steps constituting a subroutine as shown in the flow chart of FIG. 3.

The first plate cylinder 11 is first moved to the image recording position shown in the two-dot chain line in FIG. 1. (step S11).

Next, two blank plates are fed to the outer periphery of the first plate cylinder 11 (step S12). To achieve the feeding of the plates, the pair of clamping jaws, not shown, grip the forward end of the plate drawn from the supply cassette 31, and the rear end of each plate cut by the cutter 32.

Then, images are recorded on the plates mounted peripherally of the first plate cylinder 11 (step S13). For recording the images, the image recorder 25 irradiates the plates mounted peripherally of the first plate cylinder 11 with a modulated laser beam while the first plate cylinder 11 is rotated at low speed.

Next, the images recorded on the plates are developed (step S14). The developing step is executed by raising the developing device 26 from the standby position shown in solid lines to the developing position shown in two-dot chain lines in FIG. 1 and thereafter successively moving the developing unit, fixing unit and squeezing unit into contact with the two plates rotating with the first plate cylinder 11.

Upon completion of the developing step, the first plate cylinder 11 is moved to the first printing position shown in the solid line in FIG. 1 (step S15).

Subsequently, the printing machine carries out an operation similar to steps S11 to S15 by way of a prepress process for the plates mounted peripherally of the second plate cylinder 12 (steps S16 to S20). Completion of the prepress steps for the plates mounted peripherally of the first and second plate cylinders 11 and 12 brings the prepress process to an end.

Referring again to FIG. 2, the prepress process is followed by a printing process for printing the printing paper with the plates mounted on the first and second plate cylinders 11 and 12 (step S2).

In the printing process, each dampening water feeder 21 and each ink feeder 20 are first placed in contact with only a corresponding one of the image areas on the four plates mounted on the first and second plate cylinders 11 and 12. Consequently, dampening water and inks are fed to the image areas on the plates from the corresponding dampening water feeders 21 and ink feeders 20, respectively. These inks are transferred from the plates to the corresponding regions of the first and second blanket cylinders 13 and 14, respectively.

Then, the printing paper is fed to the paper feed cylinder 16. The printing paper is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper wrapped around the impression cylinder 15 in its first rotation, and the magenta and yellow inks in its second rotation.

The forward end of the printing paper printed in the four colors is passed from the impression cylinder 15 to the paper discharge cylinder 17. This printing paper is transported by the pair of chains 19 toward the paper discharge station 28, and discharged to the paper discharge station 28.

Upon completion of the printing process, the plates used in the printing are removed (step S3). To remove the plates, the first plate cylinder 11 is first moved to the image recording position shown in the two-dot chain line in FIG. 1. Then, while the first plate cylinder 11 is rotated clockwise, a guide member not shown guides an end of each plate from the first plate cylinder 11 toward the discharge cassette 35, and stores the plate in the approximately U-shaped state in the discharge cassette 35.

Upon completion of the plate removing step, the first and second blanket cylinders 13 and 14 are cleaned by the blanket cleaning unit 29 (step S4).

After completing the cleaning of the first and second blanket cylinders 13 and 14, the printing machine determines whether or not a further image is to be printed (step S5). If a further printing operation is required, the machine repeats steps S1 to S4.

If the printing operation is ended, the printing machine cleans the inks (step S6). For cleaning the inks, an ink cleaning device, not shown, provided for each ink feeder 20 removes the ink adhering to the ink rollers and ink source of each ink feeder 20.

With completion of the ink cleaning step, the printing machine ends the entire process.

[Forward-End Clamping mechanism 41 and Rear-End Clamping mechanism 42]

The printing machine described above uses a forward-end clamping mechanism 41 and a rear-end clamping mechanism 42 for mounting each printing plate on the periphery of each of the first and second plate cylinders 11 and 12. The forward-end clamping mechanism 41 is used for clamping the forward end of each plate, while the rear-end clamping mechanism 42 is used for clamping the rear end of each plate and straining the plate over the periphery of the plate cylinder 11 or 12.

Figure 4:
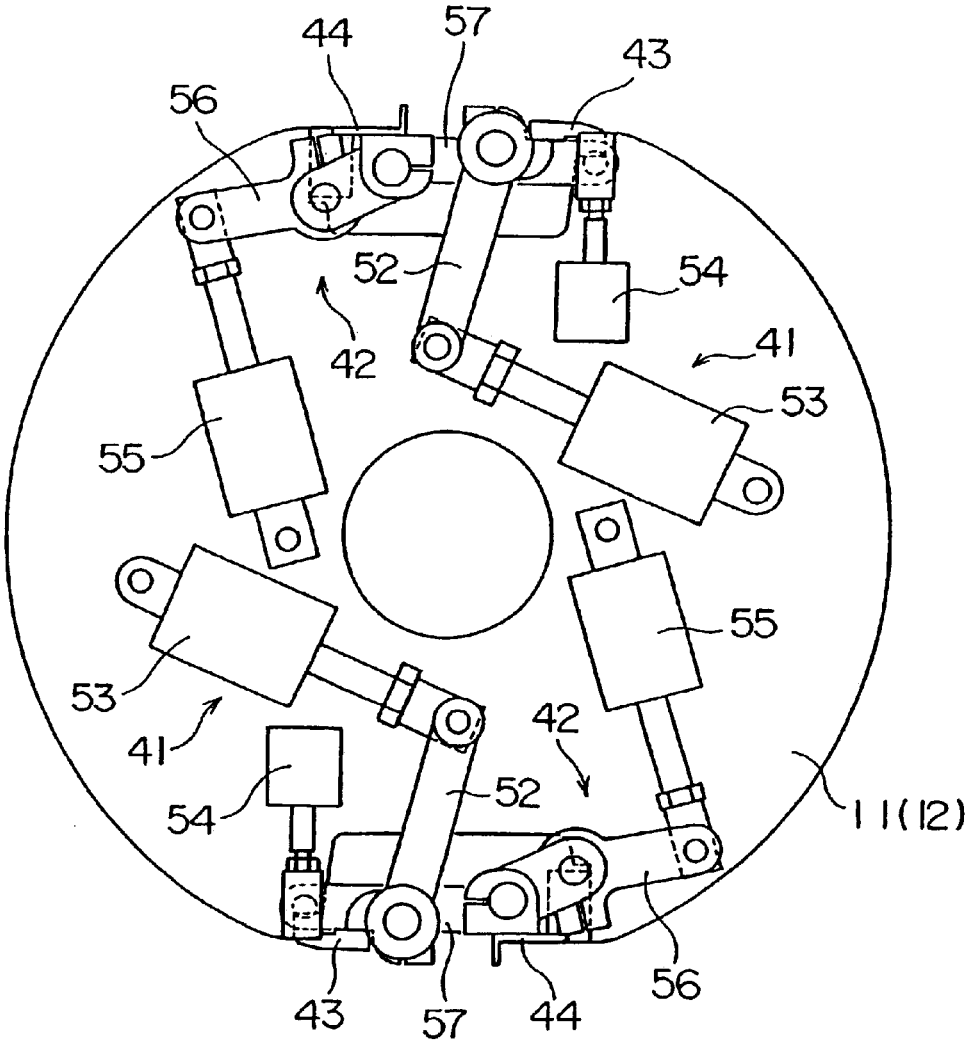
FIG. 4 is a schematic side view showing forward-end clamping mechanisms and rear-end clamping mechanisms arranged on a first plate cylinder or second plate cylinder.

FIG. 4 is a schematic side view showing the forward-end clamping mechanisms 41 and rear-end clamping mechanisms 42 arranged on the first plate cylinder 11 or second plate cylinder 12.

As noted hereinbefore, two plates are mounted peripherally of each of the first plate cylinder 11 and second plate cylinder 12. Thus, each of the first and second plate cylinders 11 and 12 has two forward-end clamping mechanisms 41 and two rear-end clamping mechanisms 42. The forward-end clamping mechanisms 41 are 180 degrees spaced from each other, and so are the rear-end clamping mechanisms 42.

The forward-end clamping mechanisms 41 constitute the forward-end clamping jaw and forward-end clamping jaw switching device of this invention. The rear-end clamping mechanisms 42 constitute the rear-end clamping jaw, rear-end clamping jaw switching device, and straining device of the invention.

Figure 5:
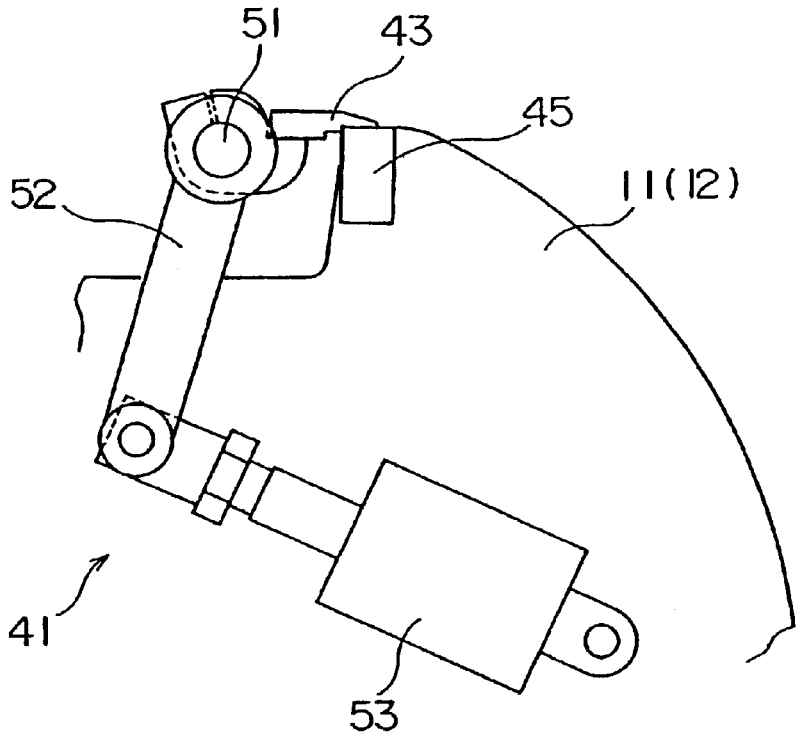
FIG. 5 is a side view of a forward-end clamping mechanism.
Figure 6:
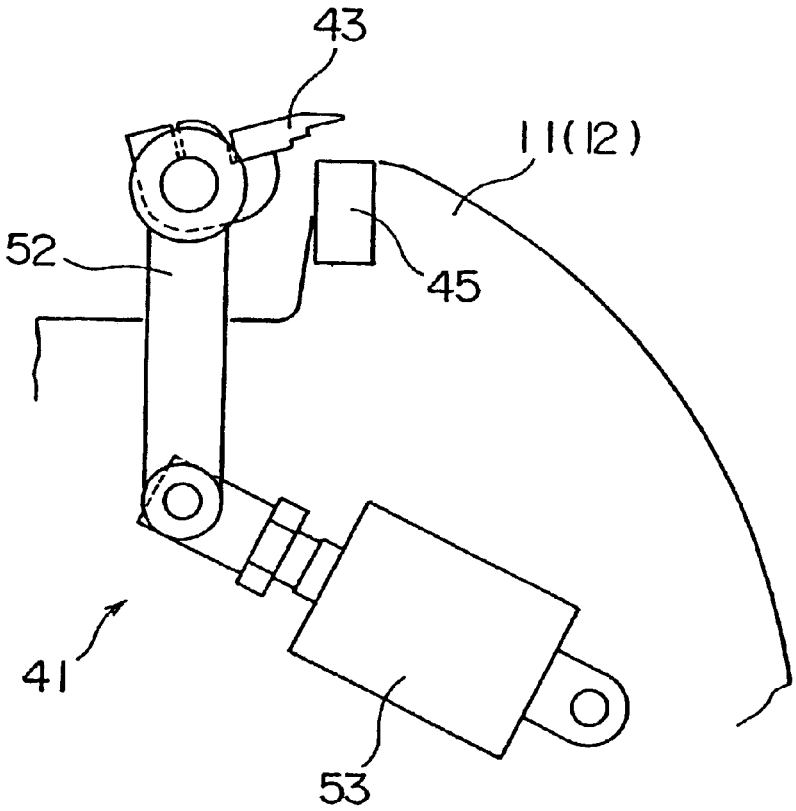
FIG. 6 is a side view of the forward-end clamping mechanism.

The construction of the forward-end clamping mechanisms 41 will be described first. FIGS. 5 and 6 are side views showing one of the forward-end clamping mechanisms 41.

This forward-end clamping mechanism 41 includes an arm 52 swingable about an axis 51 fixed to the first plate cylinder 11 or second plate cylinder 12, an air cylinder 53 having a proximal end thereof fixed to an end surface of the plate cylinder 11 or 12, with a cylinder rod thereof connected at a distal end to an end of the arm 52, a forward-end clamping jaw 43 attached to the other end of the arm 52, and a clamping base 45 fixed to the plate cylinder 11 or 12 in a position for contacting the forward-end clamping jaw 43.

In this forward-end clamping mechanism 41, when the cylinder rod of the air cylinder 53 is extended, as shown in FIG. 5, the forward-end clamping jaw 43 is placed in a clamping position contacting the clamping base 45 for clamping the forward end of a printing plate. When the cylinder rod of the air cylinder 53 is retracted, as shown in FIG. 6, the forward-end clamping jaw 43 is placed in a release position separated from the clamping base 45 for releasing the forward end of the printing plate.

Figure 7:
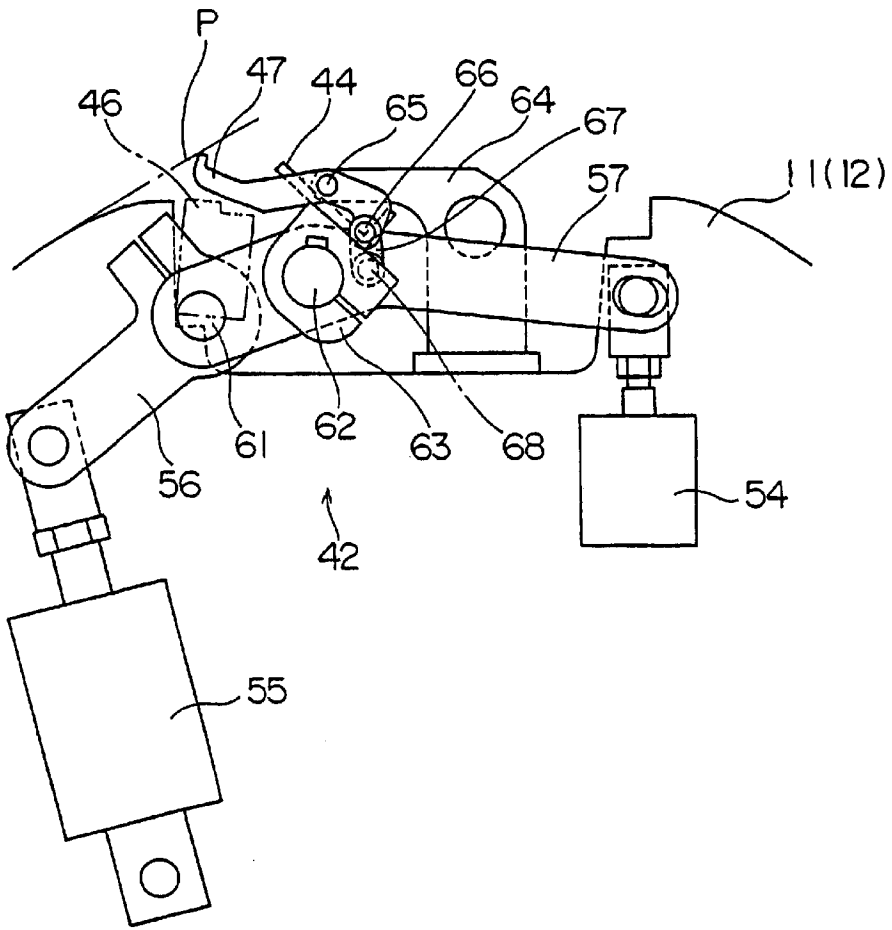
FIG. 7 is a side view of a rear-end clamping mechanism.
Figure 8:
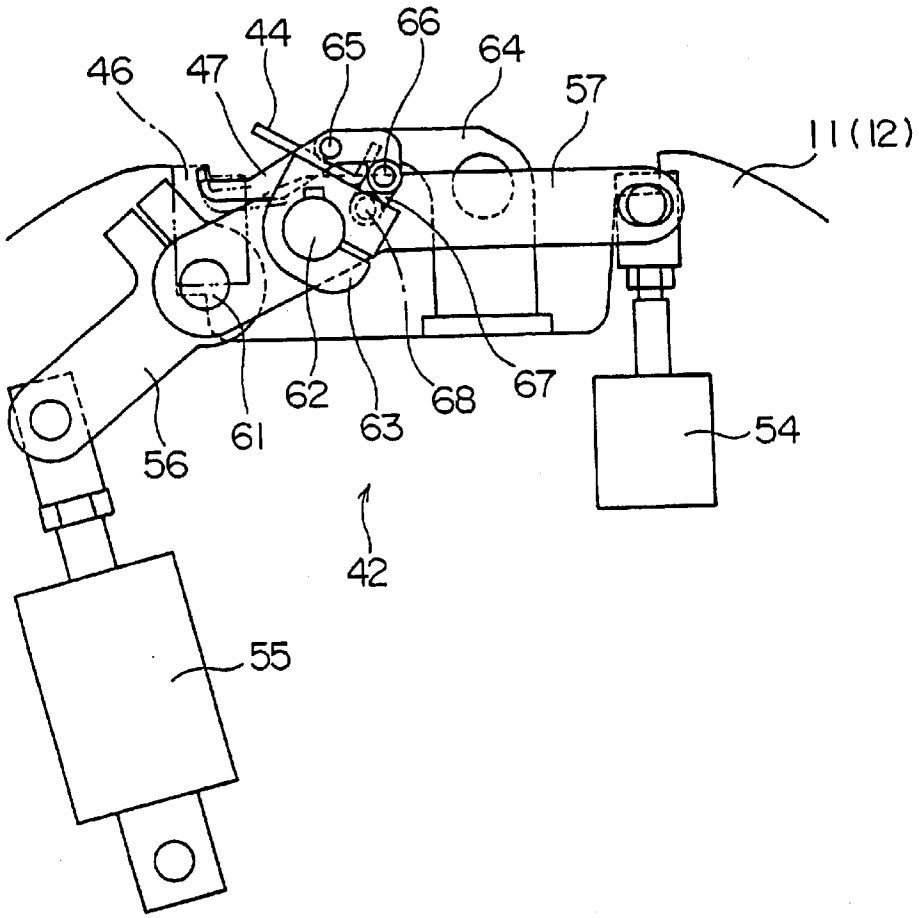
FIG. 8 is a side view of the rear-end clamping mechanism.
Figure 9:
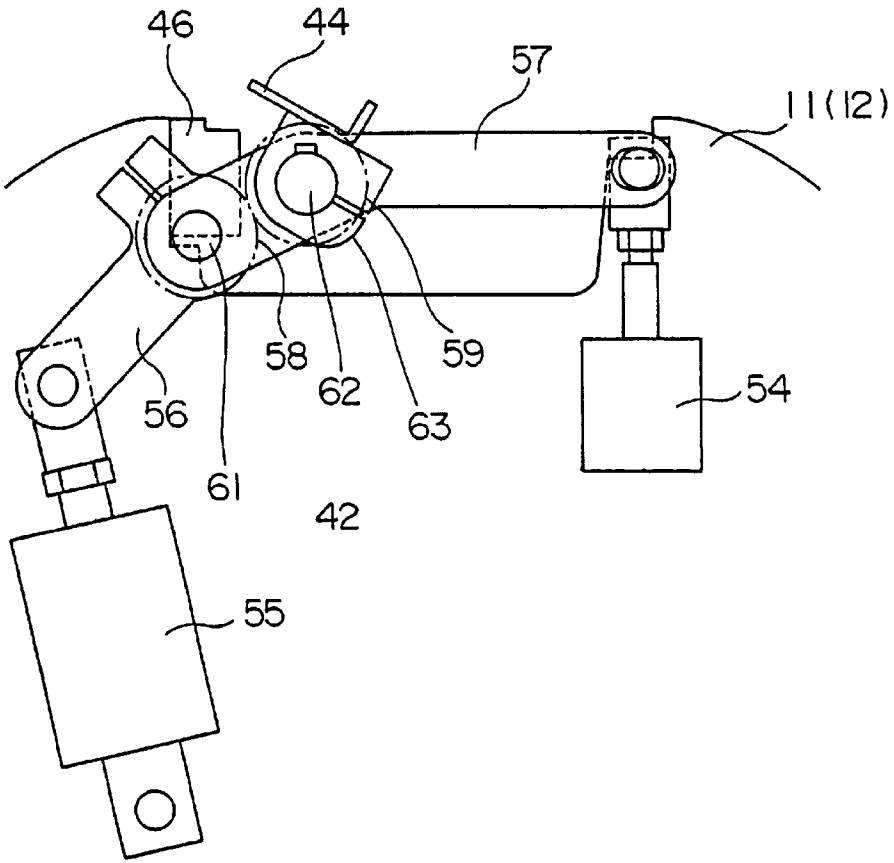
FIG. 9 is a side view of the rear-end clamping mechanism.
Figure 10:
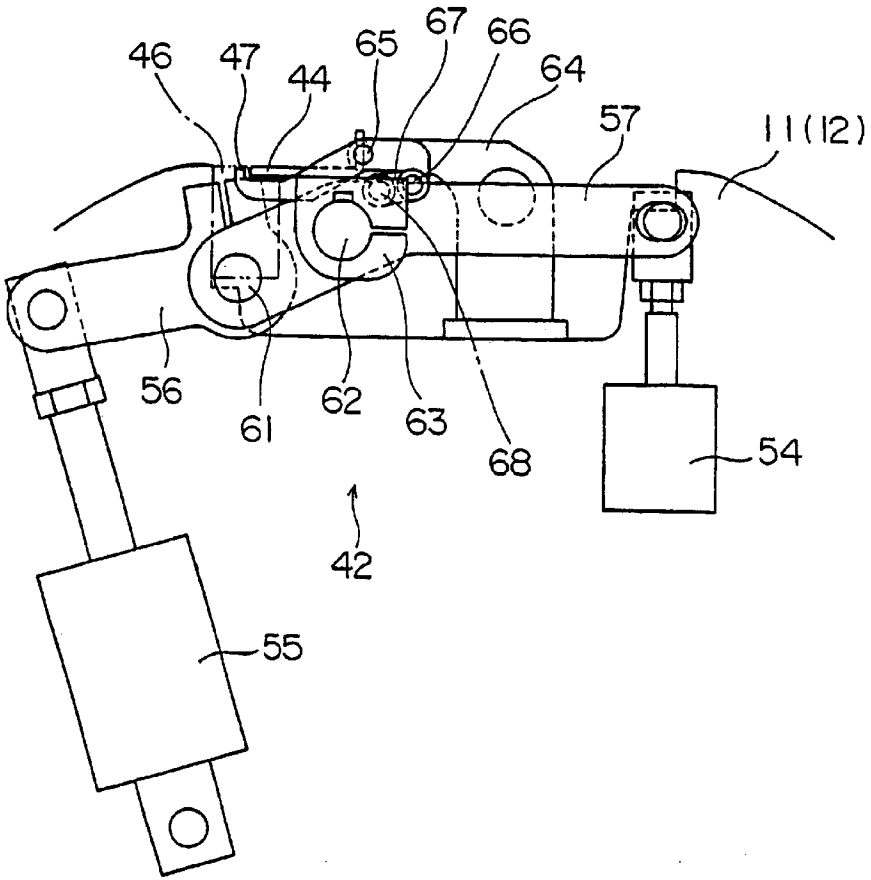
FIG. 10 is a side view of the rear-end clamping mechanism.
Figure 11:
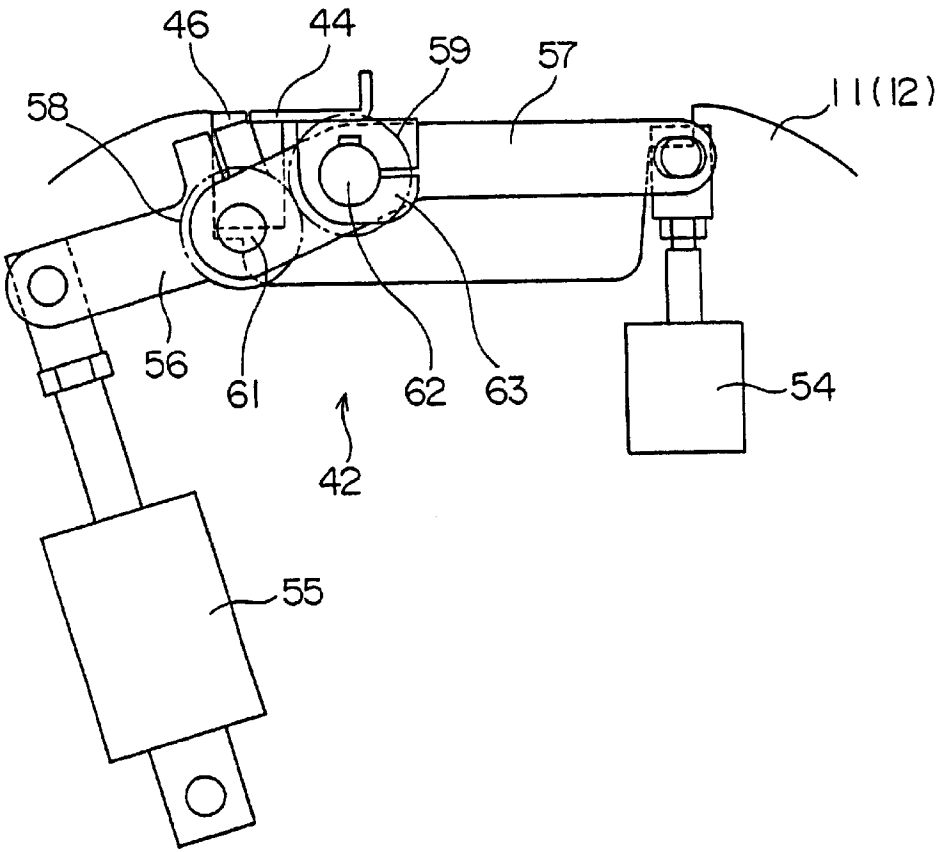
FIG. 11 is a side view of the rear-end clamping mechanism.
Figure 12:
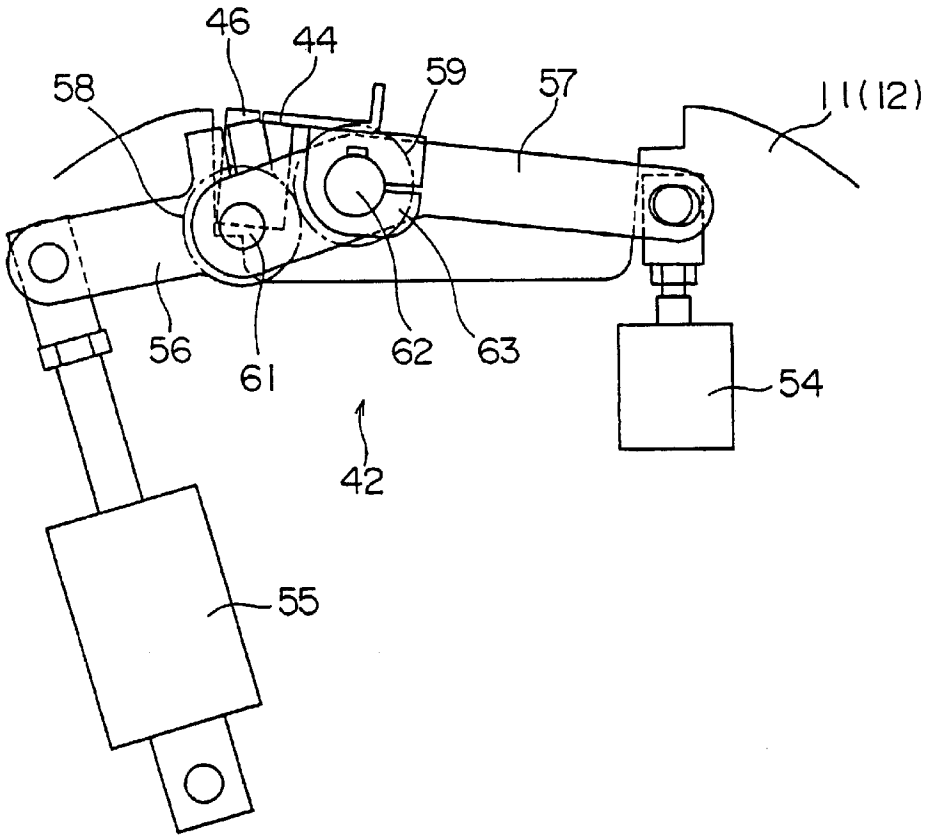
FIG. 12 is a side view of the rear-end clamping mechanism.
Figure 13:
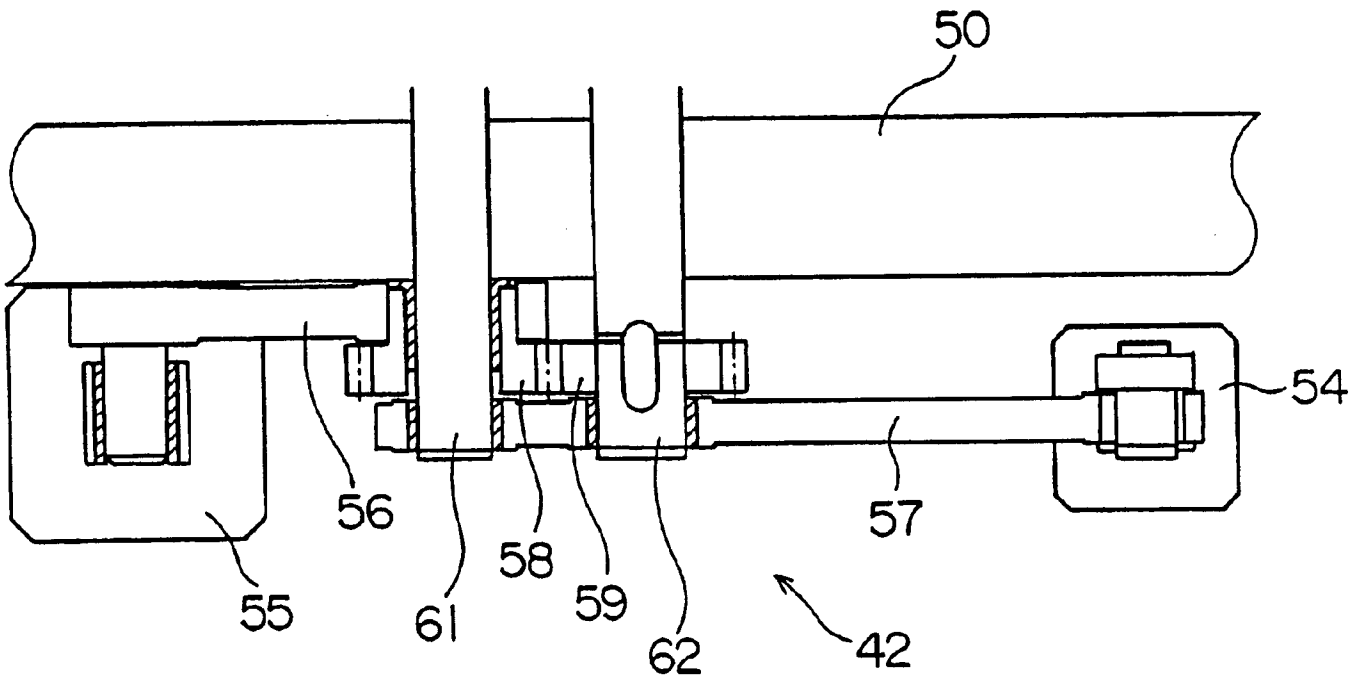
FIG. 13 is a plan view of the rear-end clamping mechanism.

The construction of the rear-end clamping mechanisms 42 will be described next. FIGS. 7 through 12 are side views showing one of the rear-end clamping mechanisms 42. FIG. 13 is a plan view showing the rear-end clamping mechanism 42. FIG. 7 shows a the state where cylinder rods of air cylinders 54 and 55 are retracted. FIGS. 8 and 9 show a state where only the cylinder rod of air cylinder 54 is extended. FIGS. 10 and 11 show a state where the cylinder rods of air cylinders 54 and 55 are extended. FIG. 12 shows a state where the cylinder rod of air cylinder 55 is further extended. FIGS. 7, 8 and 10 omit illustration of an idler gear 58 and a rear-end clamping jaw drive gear 59. FIGS. 9, 11, 12 and 13 omit illustration of pop-up elements 47.

This rear-end clamping mechanism 42 includes an arm 56 swingable about an axis 61 fixed to the first plate cylinder 11 or second plate cylinder 12, an air cylinder 55 having a proximal end thereof fixed to an end surface of the plate cylinder 11 or 12, and a cylinder rod thereof connected at a distal end to an end of the arm 56, an arm 57 swingable about an axis 62 fixed to the plate cylinder 11 or 12, and an air cylinder 54 having a proximal end thereof fixed to the end surface of the plate cylinder 11 or 12, with a cylinder rod thereof connected at a distal end to an end of the arm 57. The other end of the arm 57 is connected to the axis 61.

As shown in FIGS. 9, 11, 12 and 13, the arm 56 has an idler gear 58 fixed thereto and rotatable about the axis 61. The idler gear 58 is meshed with a rear-end clamping jaw drive gear 59 rotatable about the axis 62. As shown in FIGS. 7, 8 and 10, the rear-end clamping jaw drive gear 59 is connected to a bracket 63 supporting a rear-end clamping jaw 44. Thus, the rear-end clamping jaw 44 is rotatable about the axis 62 synchronously with the idler gear 58 and rear-end clamping jaw drive gear 59.

A plurality of clamping bases 46 are arranged in positions for facing the rear-end clamping jaw 44. These clamping bases 46 are fixable to the above positions and rotatable about the axis 61.

As shown in FIGS. 7, 8 and 10, a bracket 64 is fixed to the first plate cylinder 11 or second plate cylinder 12. The bracket 64 has pop-up elements 47 swingable about an axis 65 disposed at a distal end of the bracket 64. Each pop-up element 47 has an axis 66 disposed at an end thereof and connected through a link plate 67 to an axis 68 disposed on the bracket 63 supporting the rear-end clamping jaw 44.

These pop-up elements 47 and clamping bases 46 noted above are arranged alternately in the axial direction of the first plate cylinder 11 or second plate cylinder 12 (i.e. in the direction perpendicular to the planes of FIGS. 7 through 12).

In the rear-end clamping mechanism 42 having the above construction, when the cylinder rods of air cylinders 54 and 55 are both retracted, as shown in FIG. 7, the rear-end clamping jaw 44 is placed in a release position separated from the clamping bases 46 for releasing the rear end of a printing plate. In this state, the pop-up elements 47 are placed, by the action of link plates 67, in pop-up positions with distal ends thereof projecting from the plate cylinder 11 or 12.

When, in this state, only the cylinder rod of air cylinder 54 is extended, as shown in FIG. 8, the arm 57 is moved, which in turn moves counterclockwise, while rotating, the rear-end clamping jaw drive gear 59 meshed with the idler gear 58. With this movement, the link plates 67 connected to the bracket 63 move the pop-up elements 47 once to low positions shown in two-dot chain lines in FIG. 8, and then to positions shown in solid lines in FIG. 8. In this state, upper ends of the pop-up elements 47 are disposed inwardly of the surfaces of clamping bases 46. In this state also, as shown in FIGS. 8 and 9, the rear-end clamping jaw 44 remains in the release position separated from the clamping bases 46 for releasing the rear end of the printing plate.

When, in this state, the cylinder rod of air cylinder 55 is extended, the idler gear 58 rotates about the axis 61 with swinging movement of the arm 56 about the axis 61. The rotation of the idler gear 58 rotates, along with the bracket 63, the rear-end clamping jaw drive gear 59 meshed with the idler gear 58. Consequently, as shown in FIGS. 10 and 11, the rear-end clamping jaw 44 is placed in the clamping position contacting the clamping bases 46 for clamping the rear end of the printing plate. In this state, the upper ends of pop-up elements 47 remain inwardly of the surfaces of clamping bases 46.

When the cylinder rod of air cylinder 55 is further extended by a force stronger than the force of air cylinder 54, the arm 56 and arm 57 rotate together about the axis 61 since the rear-end clamping jaw 44 and clamping bases 46 are already in contact and the positional relationship between the arm 56 and arm 57 remains unchanged. With the rotation of arm 56 and arm 57, the clamping bases 46 rotate about the axis 61 to the position shown in FIG. 12.

The above air cylinders 53, 54 and 55 may be arranged inside the plate cylinder 11 (12), or may be arranged on an end surface of plate cylinder 11 (12). Each pair of air cylinders 53, 54 or 55 may be arranged, and driven synchronously, on opposite end surfaces of plate cylinder 11 (12).

[Plate Feeder 23 and Plate Remover 24]

Figure 14:
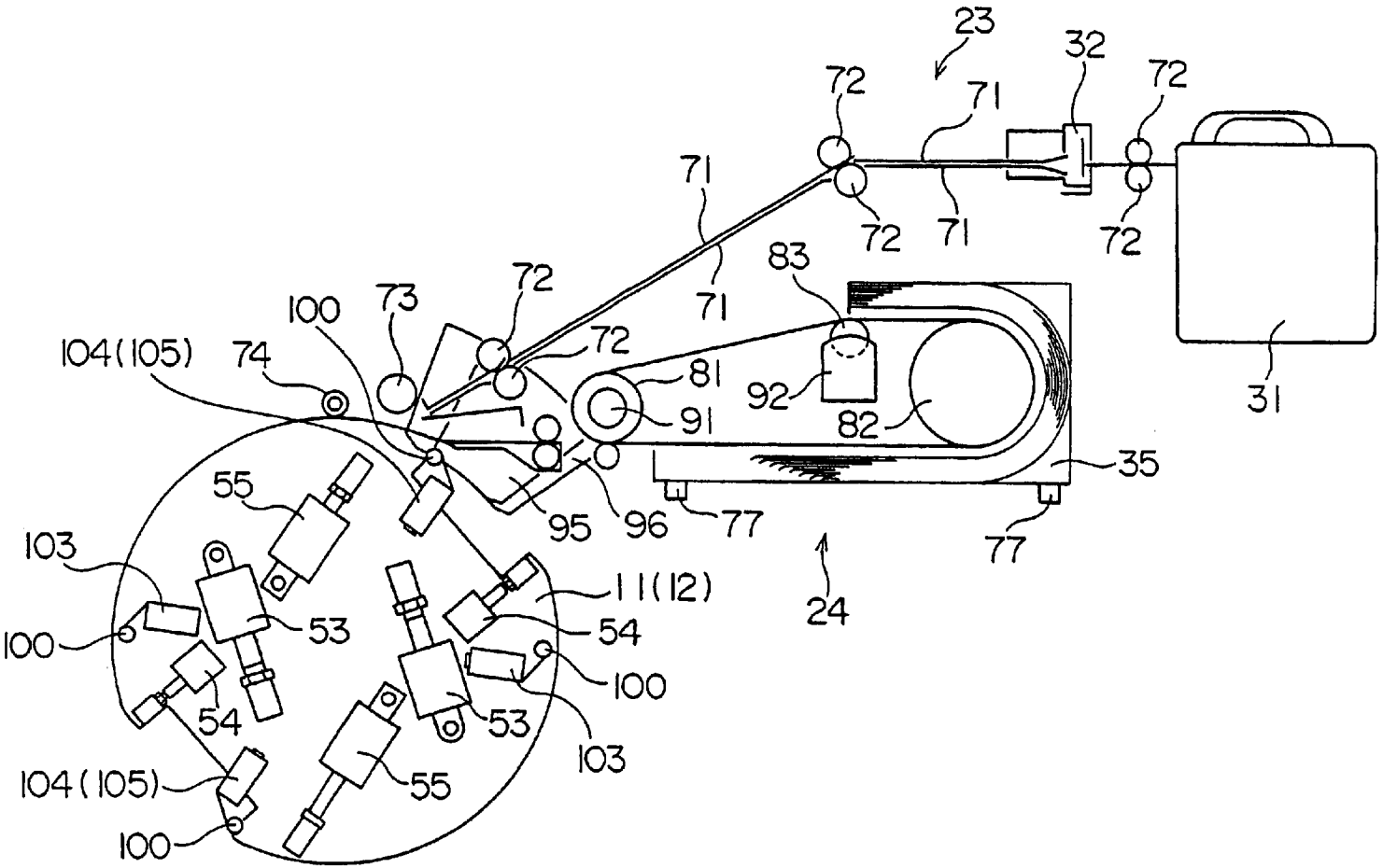
FIG. 14 is a schematic side view showing a plate feeder and a plate remover along with the first plate cylinder or second plate cylinder.

As described hereinbefore, the plate feeder 23 and plate remover 24 are arranged around the first or second plate cylinder 11 or 12 in the image recording position. FIG. 14 is a schematic side view showing the plate feeder 23 and plate remover 24 along with the first plate cylinder 11 or second plate cylinder 12.

The plate feeder 23 includes the supply cassette 31 storing a roll of elongate blank plate in light-shielded state, a guide mechanism having guide plates 71 and transport rollers 72 for guiding the forward end of the plate drawn from the cassette 31 to the surface of the first plate cylinder 11 or second plate cylinder 12, a cutter 32 for cutting the elongate plate into sheet plates, and a feeding nip roller 73 for pressing the plate on the first plate cylinder 11 or second plate cylinder 12 in time of feeding the plate.

The plate remover 24 has a discharge cassette 35 for receiving and storing, in an approximately U-shaped state, printing plates from the first or second plate cylinder 11 or 12 after a printing operation.

Figure 15:
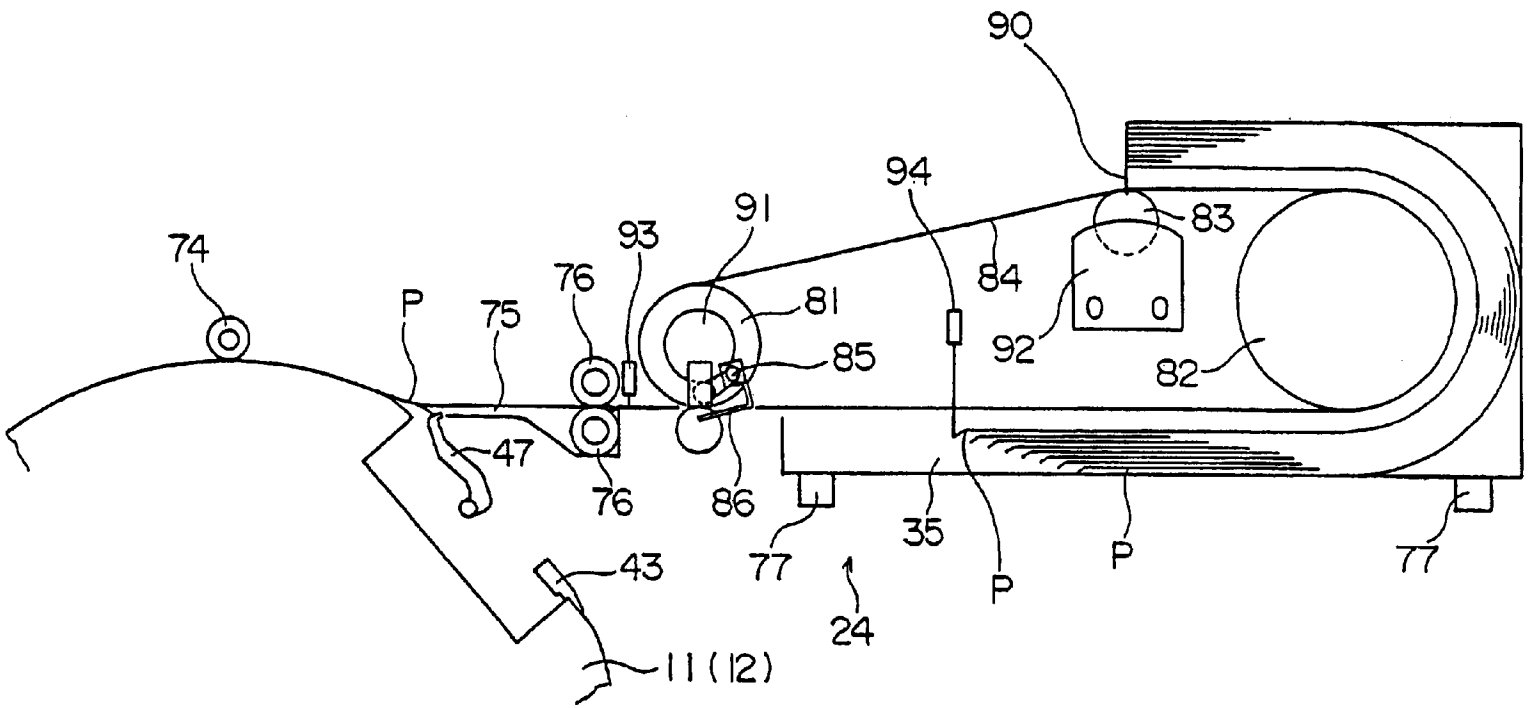
FIG. 15 is a side view showing the plate remover along with part of the first plate cylinder or second plate cylinder.

FIG. 15 is a side view showing the plate remover 24 along with part of the first plate cylinder 11 or second plate cylinder 12.

This plate remover 24 includes a removing nip roller 74 for pressing a printing plate P on the first plate cylinder 11 or second plate cylinder 12 in time of removing the printing plate P in sheet form, a separating pawl 75 for separating, from the peripheral surface of the plate cylinder 11 or 12, the rear end of printing plate P forced by the pop-up elements 47, described hereinbefore, to project outwardly of the periphery of the plate cylinder 11 or 12, a pair of transport rollers 76 for transporting the printing plate P separated by the separating pawl 75, and a transport mechanism for pinching the rear end of printing plate P transported by the transport rollers 76 and discharging the printing plate P into the discharge cassette 35.

This transport mechanism includes endless chains 84 wound around three sprockets 81, 82 and 83, a discharge clamping mechanism 85 fixed to the chains 84, a circular cam 91 for opening a discharge clamping jaw 86 of the discharge clamping mechanism 85 in order to grip the rear end of printing plate P transported by the transport rollers 76, a cam 92 for opening the discharge clamping jaw 86 of discharge clamping mechanism 85 in order to store the printing plate P in the discharge cassette 35, and sensors 93 and 94 for detecting the printing plate P.

The discharge cassette 35 for storing printing plates in an approximately U-shaped state is supported by a pair of linear guides 77 to be movable axially of the sprocket 82 and the first plate cylinder 11 or second plate cylinder 12 (in directions perpendicular to the planes of FIGS. 14 and 15). Thus, the discharge cassette 35 containing the printing plates P may be drawn axially of the plate cylinder 11 or 12 for removal.

Figure 16A:
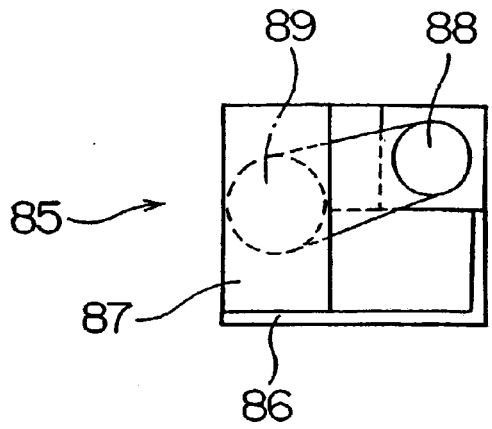
FIG. 16A is a side view showing a discharge clamp mechanism.
Figure 16B:
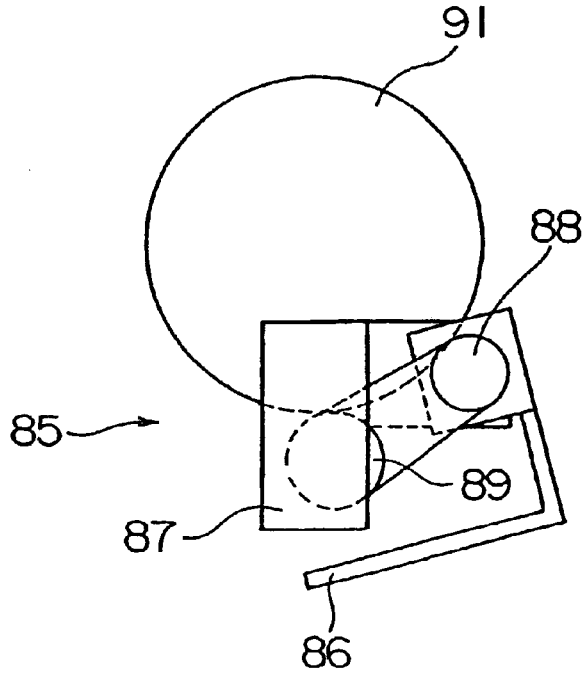
FIG. 16B is a side view showing the discharge clamp mechanism with a cam.

FIG. 16A is a side view showing the discharge clamping mechanism 85. FIG. 16B is a side view showing the discharge clamp mechanism with a cam.

The discharge clamping mechanism 85 includes the discharge clamping jaw 86 approximately L-shaped and swingable about an axis 88, a cam follower 89 connected to the discharge clamp 86, and a clamping base 87. The discharge clamping jaw 86 is biased by a spring not shown, and is normally placed in a pinching position with a distal end thereof contacting the clamping base 87 as shown in FIG. 16A. When the cam follower 89 contacts the cam 91 or cam 82 shown in FIG. 15, the discharge clamping jaw 86 is placed in an open position with the distal end separated from the clamping base 87 as shown in FIG. 16B.

In the plate remover 24 having the above construction, the discharge clamping mechanism 85 initially stands by in the position shown in FIG. 15. In this state, as shown in FIG. 16B, the cam follower 89 connected to the discharge clamping jaw 86 is in contact with the cam 91, and the discharge clamping jaw 86 is placed in the open position with the distal end thereof separated from the clamping base 87.

Upon lapse of a fixed lag time taken after the sensor 93 detects the rear end of printing plate P removed from the first plate cylinder 11 or second plate cylinder 12 and transported by the transport rollers 76 until the rear end of printing plate P reaches the discharge clamping mechanism 85, at least one of the three sprockets 81, 82 and 83 having the chains 84 wound therearound, whereby the sprockets 81, 82 and 83 and the chains 84 rotate counterclockwise. This moves the discharge clamping mechanism 85, disengaging the cam follower 89 from the cam 91, and the rear end of printing plate P is pinched between the discharge clamping jaw 86 and clamping base 87 of the discharge clamping mechanism 85. The printing plate P is transported along the chains 84 defining an approximately U-shaped transport path of the discharge clamping mechanism 85, to be loaded in an approximately U-shaped state into the discharge cassette 35.

The rear end (i.e. the leading end as seen in the direction of transport) of printing plate P pinched and transported by the discharge clamping mechanism 85 moves into the discharge cassette 35 and contacts a stopper 90 in the discharge cassette 35. Then, the cam follower 89 connected to the discharge clamping jaw 86 contacts the cam 92. As a result, the distal end of the discharge clamping jaw 86 is placed in the open position separated from the clamping base 87. The printing plate P transported with the rear end thereof pinched by the discharge clamping mechanism 85 stops in contact with the stopper 90. In this state, the printing plate P tends to move in a direction to bend outward due to its own flexibility, but such movement is restricted by contact of the printing plate P with the inner wall of the cassette 35. Thus, the printing plate P rests in the approximately U-shaped state in the discharge cassette 35. The discharge clamping mechanism 85 having released the rear end of printing plate P moves to and stops at the initial position shown in FIG. 15.

The above operation is repeated to discharge a plurality of printing plates P into the discharge cassette 35, and these printing plates P are stored as superimposed in the approximately U-shaped state in the discharge cassette 35. At this time, because of differences in the radius of curvature, the forward end of printing plate P discharged the later is located the closer to the first plate cylinder 11 or second plate cylinder 12 as shown in FIG. 15.

When the sensor 94 detects the forward end of printing plate P, the quantity of printing plates P stored in the discharge cassette 35 is determined to have reached the limit, and an alarm is given by an alarm device not shown. The operator having become aware of the alarm draws the discharge cassette 35 out along the pair of linear guides 77 axially of the sprocket 82, and removes the printing plates P from the discharge cassette 35. At this time, the printing plates P may be removed with the ink-bearing surfaces thereof lying inward to avoid staining the operator's hands.

[Air Cylinder Control Mechanism]

Figure 17:
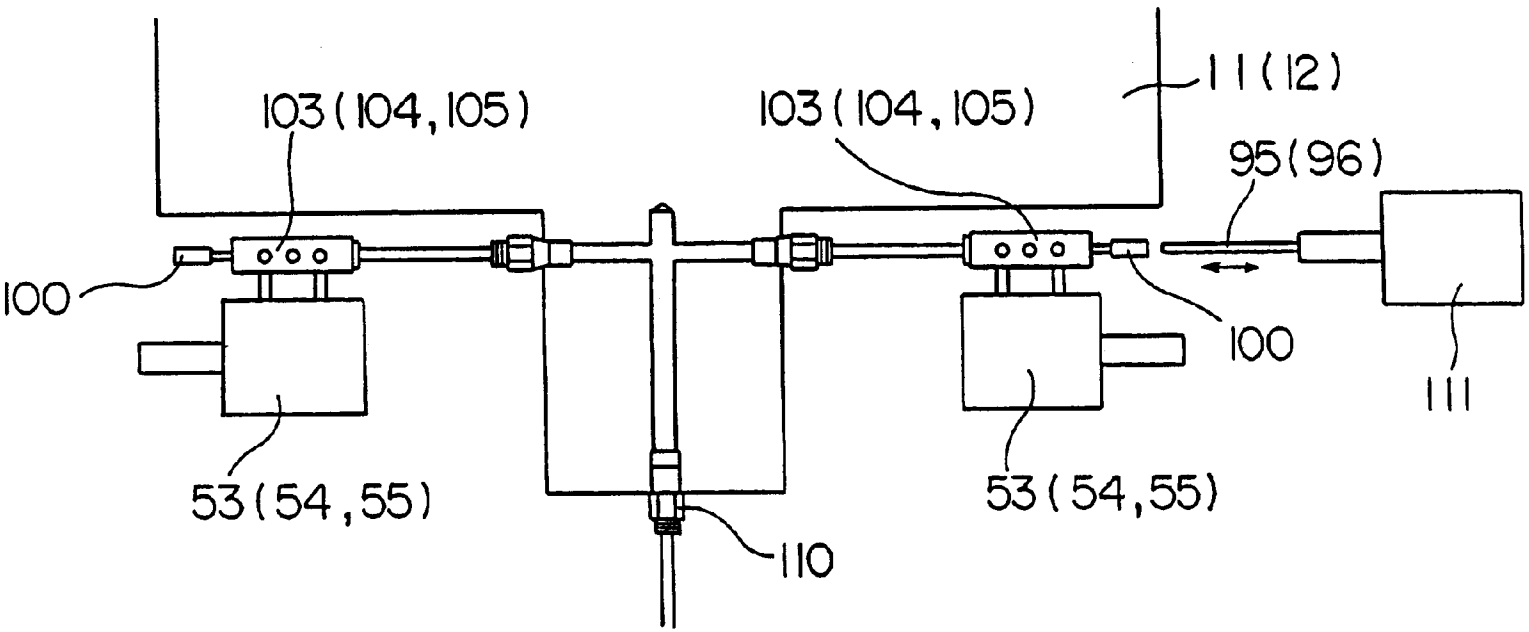
FIG. 17 is an explanatory view showing a mechanism for supplying compressed air to three air cylinders.

In the forward-end clamping mechanism 41 and rear-end clamping mechanism 42 described hereinbefore, the air cylinders 53, 54 and 55 arranged on the first plate cylinder 11 or second plate cylinder 12 are used to open and close the forward-end clamping jaw 43 and rear-end clamping jaw 44. An air cylinder control mechanism for controlling these air cylinders 53, 54 and 55 will be described next. FIG. 17 is an explanatory view showing a mechanism for supplying compressed air to the air cylinders 53, 54 and 55.

As shown in FIG. 17, the first plate cylinder 11 or second plate cylinder 12 has a rotary joint 110 mounted axially thereof and connected to a source of compressed air not shown. Each air cylinder 53 is connected to the rotary joint 110 through a mechanical valve 103 as shown in FIGS. 14 and 17. Similarly, each air cylinder 54 is connected to the rotary joint 110 through a mechanical valve 104 as shown in FIGS. 14 and 17. Each air cylinder 55 is connected to the rotary joint 110 through a mechanical valve 105 as shown in FIGS. 14 and 17. The mechanical valve 104 and mechanical valve 105 are arranged in the same position in the side view shown in FIG. 14.

As shown in FIGS. 14 and 17, each of these mechanical valves 103, 104 and 105 has a bearing 100 for contacting a cam 95 or a cam 96 arranged outwardly of the first plate cylinder 11 or second plate cylinder 12. The supply of compressed air to each air cylinder 53, 54 or 55 varies with the bearing 100 moving into or out of contact with the cam 95 or 96.

More particularly, each air cylinder 53 receives compressed air from the rotary joint 110 in a direction to retract its cylinder rod when the bearing 100 of the mechanical valve 103 contacts the cam 96. Each air cylinder 54 receives compressed air from the rotary joint 110 in a direction to retract its cylinder rod when the bearing 100 of the mechanical valve 104 contacts the cam 95. Each air cylinder 55 receives compressed air from the rotary joint 110 in a direction to retract its cylinder rod when the bearing 100 of the mechanical valve 105 contacts the cam 96.

Where, as described above, the cams 95 and 96 arranged outwardly of the first plate cylinder 11 or second plate cylinder 12 and the mechanical valves 103, 104 and 105 are used to control the air cylinders 53, 54 and 55 arranged on the plate cylinder 11 or 12, the air cylinders 53, 54 and 55 may be control accurately without using an expensive manifold rotary joint.

As shown in FIG. 17, the cam 95 and cam 96 are movable away from the first plate cylinder 11 or second plate cylinder 12 by drive of an air cylinder 111. When the plate cylinder 11 or 12 moves, the cam 95 and cam 96 are moved to retracted positions.

[Plate Feeding Operation]

A plate feeding operation for mounting a printing plate P peripherally of the first plate cylinder 11 or second plate cylinder 12 to be used for printing will be described next.

When feeding the printing plate P to the plate cylinder 11 or 12, the cutter 32 cuts the elongate printing plate drawn out of the supply cassette 31, and then the guide mechanism including the guide plates 71 and transport rollers 72 transports the plate P toward the plate cylinder 11 or 12. At this time, the bearing 100 of one of the mechanical valves 103 contacts the cam 96. Consequently, as shown in FIG. 6, the forward-end clamping jaw 43 of forward-end clamping mechanism 41 is placed in the release position.

When the forward end of printing plate P arrives at the forward-end clamping mechanism 41, the plate cylinder 11 or 12 is rotated at low speed counterclockwise in the drawings. As a result, the bearing 100 of the mechanical valve 103 is separated from the cam 96, and the forward-end clamping jaw 43 of forward-end clamping mechanism 41 is placed in the clamping position as shown in FIG. 5. In this state, the plate cylinder 11 or 12 is rotated at low speed counterclockwise in the drawings. The printing plate P is pinched by the plate cylinder 11 or 12 and the feeding nip roller 73 to be wrapped around the plate cylinder 11 or 12.

When the rear end of printing plate P arrives at the rear-end clamping mechanism 42, the bearing 100 of one of the mechanical valves 104 contacts the cam 95, and the bearing 100 of one of the mechanical valves 105 contacts the cam 96. Thus, as shown in FIG. 7, the rear-end clamping jaw 44 is placed in the release position.

In this state, the first plate cylinder 11 or second plate cylinder 12 continues to rotate at low speed counterclockwise in the drawings. After the bearing 100 of the mechanical valve 104 is separated from the cam 95, the bearing 100 of the mechanical valve 105 is separated from the cam 96. As a result, the rear-end clamping jaw 44 passes through the positions shown in FIGS. 8 and 9 to the clamping position shown in FIGS. 10 and 11 to pinch the rear end of printing plate P with the clamping bases 46. Then, as shown in FIG. 12, the clamping bases 46 rotate about the axis 61 to pull the rear end of printing plate P pinched between the rear-end clamping jaw 44 and clamping bases 46. The printing plate P is thereby strained over the periphery of the plate cylinder 11 or 12. This completes the operation for feeding the printing plate P.

[Plate Removing Operation]

A plate removing operation for removing a printing plate P having been used in printing from the first plate cylinder 11 or second plate cylinder 12 will be described next.

The first plate cylinder 11 or second plate cylinder 12 is rotated clockwise in the drawings, with the rear-end clamping mechanism 42 clamping the rear end of printing plate P. When the bearing 100 of mechanical valve 105 contacts the cam 96, as shown in FIG. 8, the cylinder rod of air cylinder 55 is retracted to move the rear-end clamping jaw 44 to the release position. When the bearing 100 of mechanical valve 104 contacts the cam 95, as shown in FIG. 7, the cylinder rod of air cylinder 54 is retracted to move the pop-up elements 47 to the pop-up position having the distal ends thereof projecting outwardly of the plate cylinder 11 or 12. Consequently, as shown in a phantom line in FIG. 7, the printing plate P mounted peripherally of the plate cylinder 11 or 12 projects outward.

In this state, the plate cylinder 11 or 12 is rotated clockwise in the drawings, with the printing plate P pinched between the plate cylinder 11 or 12 and nip roller 74. Then the rear end of printing plate P projecting from the periphery of the plate cylinder 11 or 12 by the action of pop-up elements 47 is separated from the peripheral surface of the plate cylinder 11 or 12 by the action of the separating pawl 75 as shown in FIG. 15. The printing plate P separated from the plate cylinder 11 or 12 is pinched and transported toward the discharge cassette 35 by the pair of transport rollers 76.

Upon lapse of the fixed lag time after the sensor 93 detects the rear end of printing plate P transported toward the discharge cassette 35, the three sprockets 81, 82 and 83 having the chains 84 wound therearound are driven, and the rear end of printing plate P is pinched between the discharge clamping jaw 86 and clamping base 87 of the discharge clamping mechanism 85. Subsequently, the printing plate P is transported along the chains 84 defining the approximately U-shaped transport path of the discharge clamping mechanism 85, to be loaded in the approximately U-shaped state into the discharge cassette 35. The printing plate P transported with the rear end thereof pinched by the discharge clamping mechanism 85 stops inside the discharge cassette 35 when the rear end of printing plate P contacts the stopper 90 in the discharge cassette 35.

[Other Embodiments]

In the embodiment described above, a two-segmented plate cylinder is used as the first plate cylinder 11 or second plate cylinder 12 for holding two printing plates P mounted peripherally thereof, and having two forward-end clamping mechanisms 41 and two rear-end clamping mechanisms 42 respectively arranged equidistantly. Thus, the first plate cylinder 11 or second plate cylinder 12 has an excellent weight balance to be steadily rotatable at high speed. Besides being a two-segmented plate cylinder, the first plate cylinder 11 or second plate cylinder 12 may be an n-segmented cylinder, where n is an integer 2 or more, for supporting printing plates n in number on the periphery thereof. In this case, the forward-end clamping mechanisms 41 and rear-end clamping mechanisms 42 may be n in number and arranged equidistantly.

Where the first plate cylinder 11 or second plate cylinder 12 holds a single printing plate mounted peripherally thereof, a weight or the like may be used to secure a good weight balance.

Figure 18:
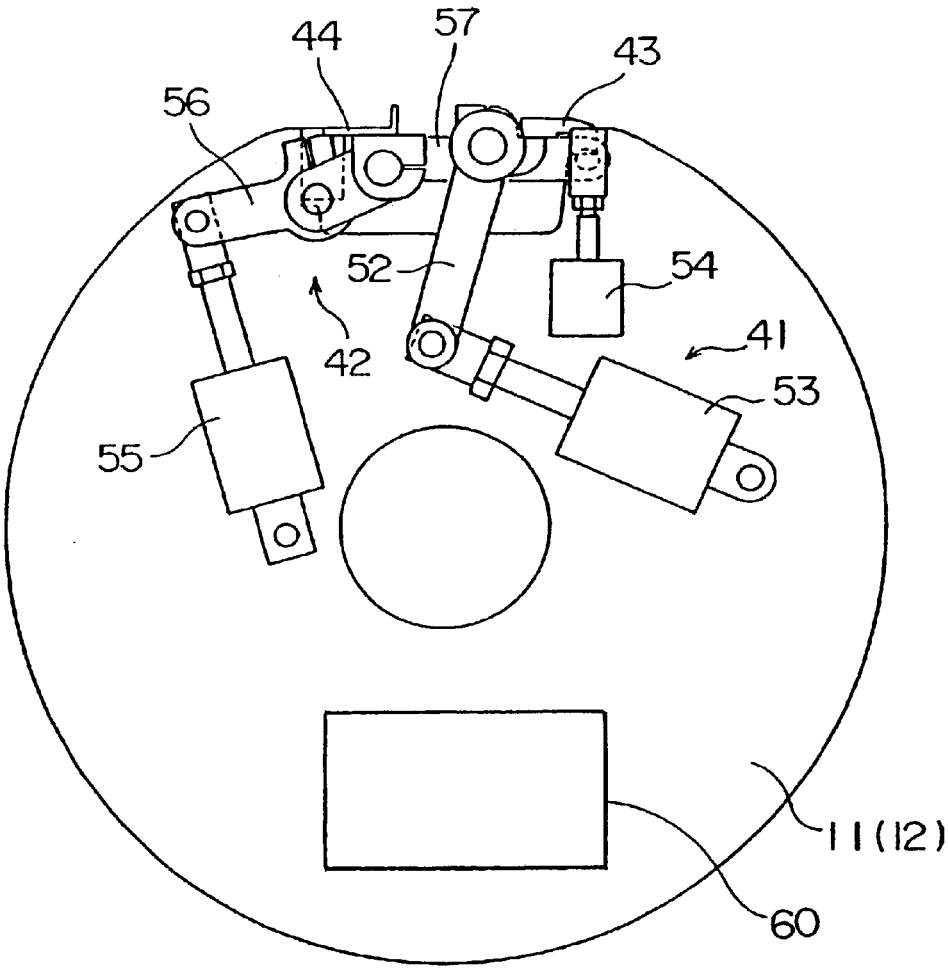
FIG. 18 is a schematic side view showing a modified first plate cylinder or second plate cylinder.

FIG. 18 is a schematic side view showing such a plate cylinder 11 or 12.

In this embodiment, the first plate cylinder 11 or second plate cylinder 12 has a single forward-end clamping mechanism 41 and a single rear-end clamping mechanism 42 arranged peripherally thereof. A weight 60 is disposed in a position balancing against the forward-end clamping mechanism 41 and rear-end clamping mechanism 42. Where the plate cylinder 11 or 12 holds a single printing plate mounted peripherally thereof, such weight 60 may be used to secure a good weight balance. Then, the plate cylinder 11 or 12 may be rotated steadily at high speed.

In the preceding embodiment, the air cylinders 53, 54 and 55 arranged on the first plate cylinder 11 or second plate cylinder 12 are controlled by using the cams 95 and 96 arranged outwardly of the plate cylinder 11 or 12 and the mechanical valves 103, 104 and 105. However, such mechanical valves may be omitted in favor of a manifold rotary joint.

Figure 19:
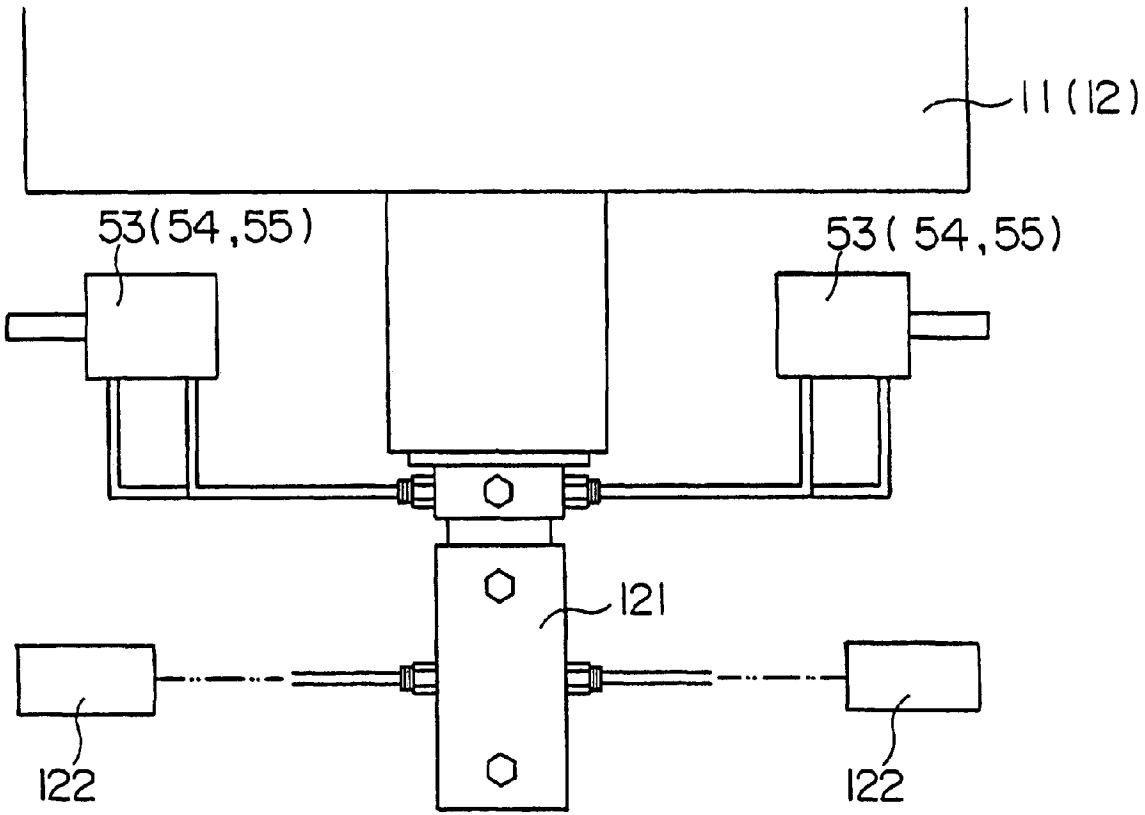
FIG. 19 is an explanatory view showing a modified mechanism for supplying compressed air to the air cylinders.

FIG. 19 is an explanatory view showing a mechanism for supplying compressed air to the air cylinders 53, 54 and 55 in such an embodiment.

In this embodiment, the air cylinders 53, 54 and 55 arranged on the first plate cylinder 11 or second plate cylinder 12 are connected through a manifold rotary joint 121 to associated electromagnetic valves 122, respectively. This embodiment can control the supply of compressed air to each of the air cylinders 53, 54 and 55 without using mechanical valves.

In the preceding embodiment, the rear-end clamping jaw 44 is moved with the clamping bases 46 in the direction to strain the printing plate P. Instead, the forward-end clamping jaw 43 may be moved in the direction to strain the printing plate P.

In the preceding embodiment, the rear-end clamping mechanism 42 includes the pop-up elements 47 for raising the rear end of the printing plate clamped by the rear-end clamping mechanism 42. Instead, the forward-end clamping mechanism 41 may include pop-up elements for raising the forward end of the printing plate clamped by the forward-end clamping mechanism 41.

Further, in the foregoing embodiments, the invention is applied to a printing machine for receiving image data, making printing plates, and printing images by using the printing plates. This invention is applicable also to an ordinary printing machine that performs only a printing operation. The invention is applicable also to a printing plate recording apparatus that does not print, but only records images on printing plates mounted on plate cylinders.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Applications No. 2002-071169 filed in the Japanese Patent Office on Mar. 15, 2002 and No. 2002-071170 filed in the Japanese Patent Office on Mar. 15, 2002, the entire disclosure of which is incorporated herein by reference.

What is claimed is:

1. A printing plate mounting apparatus for mounting a printing plate peripherally of a plate cylinder, comprising:

a forward-end clamping jaw disposed peripherally of said plate cylinder for pinching a forward end of said printing plate with a clamping base;

a forward-end clamping jaw switching means disposed on one end surface of said plate cylinder for opening and closing said forward-end clamping jaw;

a plurality of rear-end clamping jaws disposed peripherally of said plate cylinder for pinching a rear end of said printing plate with a clamping base;

a rear-end clamping jaw switching means disposed on one end surface of said plate cylinder for opening and closing said plurality of rear-end clamping jaws together, and straining means disposed on said plate cylinder for moving said rear-end clamping jaws in a direction for straining the printing plate pinched.

2. A printing plate mounting apparatus as defined in claim 1, wherein said straining means further strain the printing plate pinched by said forward-end clamping jaw and said rear-end clamping jaws, by rotating one of said forward-end clamping jaw and said rear-end clamping jaws with the clamping base.

3. A printing plate mounting apparatus as defined in claim 2, wherein said plate cylinder is an n-segmented cylinder, where n is an integer 2 or more, for supporting printing plates n in number, said forward-end clamping jaw, said forward-end clamping jaw switching means, said rear-end clamping jaws, said rear-end clamping jaw switching means and said straining means, respectively, are n in number and arranged equidistantly.

4. A printing plate mounting apparatus as defined in claim 1, wherein said forward-end clamping jaw switching means and said rear-end clamping jaw switching means include air cylinders, respectively, said air cylinders being connected to an air source disposed outwardly of said plate cylinder, through a rotary joint disposed axially of said plate cylinder.

5. A printing plate mounting apparatus as defined in claim 4, further comprising mechanical valves each disposed between one of said air cylinders and said rotary joint to be rotatable with said plate cylinder and contacting a contact member disposed outwardly of said plate cylinder to vary air supply to said one of said air cylinders.

6. A printing plate mounting apparatus as defined in claim 5, wherein said plate cylinder is an n-segmented cylinder, where n is an integer 2 or more, for supporting printing plates n in number, said forward-end clamping jaw, said forward-end clamping jaw switching means, said rear-end clamping jaws said rear-end clamping jaw switching means and said straining means, respectively, are n in number and arranged equidistantly.

7. A printing plate mounting apparatus as defined in claim 1, further comprising plate pop-up means for projecting one of the forward end and the rear end of said printing plate outwardly of an outer periphery of said plate cylinder when one of said forward-end clamping jaw and said rear-end clamping jaws is opened to remove said printing plate from said plate cylinder.

8. A printing plate mounting apparatus as defined in claim 7, further comprising a guide member disposed adjacent said outer periphery of said plate cylinder for guiding, toward a plate store, said one of the forward end and the rear end of said printing plate projected by said pop-up means outwardly of said outer periphery of said plate cylinder.

9. A printing plate mounting apparatus as defined in claim 7, wherein said pop-up means includes pop-up elements movable between a contained position where distal ends of said pop-up elements are contained inside said plate cylinder, and a pop-up position where said distal ends project outwardly of said plate cylinder.

10. A printing plate mounting apparatus as defined in claim 9, wherein said pop-up means is connected through a link mechanism to one of said forward-end clamping jaw switching means and said rear-end clamping jaw switching means.

11. A printing plate mounting apparatus for mounting a printing plate peripherally of a plate cylinder, comprising:

a forward-end clamping jaw disposed peripherally of said plate cylinder for pinching a forward end of said printing plate with a clamping base;

a forward-end clamping jaw switching means disposed on one end surface of said plate cylinder for opening and closing said forward-end clamping jaw;

a plurality of rear-end clamping jaws disposed peripherally of said plate cylinder for pinching a rear end of said printing plate with a clamping base;

a rear-end clamping jaw switching means disposed on one end surface of said plate cylinder for opening and closing said plurality of rear-end clamping jaws together;

straining means disposed on said plate cylinder for moving said rear-end clamping jaws in a direction for straining the printing plate pinched;

a plate pop-up means housed inside of said plate cylinder for popping up the printing plate when discharging the printing plate mounted on a periphery of said plate cylinder by opening said rear-end clamping jaws; and a plate pop-up driving means, which is capable of activating independently of the opening of said rear-end clamping jaws, for projecting rear end of said printing plate from an outer periphery toward the outside of said plate cylinder.

12. A printing plate mounting apparatus as defined in claim 11, wherein said straining means further strain the printing plate pinched by said forward-end clamping jaw and said rear-end clamping jaws, by rotating one of said forward-end clamping jaw and said rear-end clamping jaws with the clamping base.

13. A printing plate mounting apparatus as defined in claim 12, wherein said plate cylinder is an n-segmented cylinder, where n is an integer 2 or more, for supporting printing plates n in number, said forward-end clamping jaw, said forward-end clamping jaw switching means, said rear-end clamping jaws, said rear-end clamping jaw switching means and said straining means, respectively, are n in number and arranged equidistantly.

14. A printing plate mounting apparatus as defined in claim 11, wherein said forward-end clamping jaw switching means and said rear-end clamping jaw switching means include air cylinders, respectively, said air cylinders being connected to an air source disposed outwardly of said plate cylinder, through a rotary joint disposed axially of said plate cylinder.

15. A printing plate mounting apparatus as defined in claim 14, further comprising mechanical valves each disposed between one of said air cylinders and said rotary joint to be rotatable with said plate cylinder and contacting a contact member disposed outwardly of said plate cylinder to vary air supply to said one of said air cylinders.

16. A printing plate mounting apparatus as defined in claim 15, wherein said plate cylinder is an n-segmented cylinder, where n is an integer 2 or more, for supporting printing plates n in number, said forward-end clamping jaw, said forward-end clamping jaw switching means, said rear-end clamping jaws, said rear-end clamping jaw switching means and said straining means, respectively, are n in number and arranged equidistantly.

17. A printing plate mounting apparatus as defined in claim 11, further comprising a guide member disposed adjacent said outer periphery of said plate cylinder for guiding, toward a plate store, said one of the forward end and the rear end of said printing plate projected by said pop-up means outwardly of said outer periphery of said plate cylinder.

18. A printing plate mounting apparatus as defined in claim 11, wherein said pop-up means includes pop-up elements movable between a contained position where distal ends of said pop-up elements are contained inside said plate cylinder, and a pop-up position where said distal ends project outwardly of said plate cylinder.

19. A printing plate mounting apparatus as defined in claim 18, wherein said pop-up means is connected through a link mechanism to one of said forward-end clamping jaw switching means and said rear-end clamping jaw switching means.

* * * * *